US010625967B2

(12) United States Patent
Tang et al.

(10) Patent No.: US 10,625,967 B2
(45) Date of Patent: Apr. 21, 2020

(54) PRINT OUTPUT AUXILIARY DEVICE AND PRINTING APPARATUS

(71) Applicant: Lenovo (Beijing) Co., Ltd., Beijing (CN)

(72) Inventors: Bojiong Tang, Beijing (CN); Zhiguo Fan, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/941,242

(22) Filed: Mar. 30, 2018

(65) Prior Publication Data

US 2019/0002223 A1 Jan. 3, 2019

(30) Foreign Application Priority Data

Jun. 30, 2017 (CN) ..... 2017 1 0525768

(51) Int. Cl.

| | |
|---|---|
| ***B65H 29/40*** | (2006.01) |
| ***B65H 29/14*** | (2006.01) |
| ***B65H 31/02*** | (2006.01) |
| ***B65H 29/52*** | (2006.01) |
| ***B65H 5/16*** | (2006.01) |
| ***B65H 5/36*** | (2006.01) |

(52) U.S. Cl.

CPC ..... *B65H 29/40* (2013.01); *B65H 5/16* (2013.01); *B65H 5/36* (2013.01); *B65H 29/14* (2013.01); *B65H 29/52* (2013.01); *B65H 31/02* (2013.01); *B65H 2301/4212* (2013.01); *B65H 2301/4421* (2013.01); *B65H 2404/70* (2013.01); *B65H 2701/1313* (2013.01); *B65H 2801/12* (2013.01)

(58) Field of Classification Search

CPC ..... B65H 29/40; B65H 2301/4422; B65H 2301/4423; B65H 2301/4352; B65H 2404/73; B65H 2404/733; B65H 2404/721; B65H 2404/722; B65H 5/16; B65H 5/36; B65H 31/26; B65H 2701/1313

USPC ..... 271/177, 221

See application file for complete search history.

(56) References Cited

U.S. PATENT DOCUMENTS

| | | | | |
|---|---|---|---|---|
| 4,441,702 A * | 4/1984 | Nagel | B65H 29/247 | 271/177 |
| 5,409,209 A * | 4/1995 | Nakamura | B41J 11/08 | 271/188 |
| 5,758,981 A * | 6/1998 | Lesniak | B41J 13/106 | 271/10.01 |

(Continued)

FOREIGN PATENT DOCUMENTS

| | | |
|---|---|---|
| CN | 101465014 A | 6/2009 |
| CN | 104058279 A | 9/2014 |

(Continued)

*Primary Examiner* — Michael C McCullough

(74) *Attorney, Agent, or Firm* — Anova Law Group, PLLC

(57) ABSTRACT

An auxiliary device and a printing apparatus are provided. The printing apparatus includes a print output device, including a print exit. The printing apparatus also includes an auxiliary device disposed at the print exit of the print output device and having a first position state and a second position state. During a transition of the auxiliary device between the first position state and the second position state, the auxiliary device pushes print outputted from the print exit to move in a direction away from the print exit.

19 Claims, 4 Drawing Sheets

(56) References Cited

U.S. PATENT DOCUMENTS

| | | | | |
|---|---|---|---|---|
| 5,851,008 | A * | 12/1998 | Dilanchian | B65H 29/00 271/4.07 |
| 6,322,068 | B1 * | 11/2001 | Iemura | B65H 29/26 271/177 |
| 6,478,295 | B2 * | 11/2002 | Hwang | B65H 29/26 271/115 |
| 6,832,761 | B2 * | 12/2004 | Young | B65H 29/00 271/271 |
| 6,991,170 | B2 * | 1/2006 | Hirasawa | B65H 9/101 235/475 |
| 7,665,837 | B2 * | 2/2010 | Son | B41J 11/0015 347/101 |
| 8,282,205 | B2 * | 10/2012 | Choi | B41J 13/0027 347/104 |
| 9,567,181 | B2 * | 2/2017 | Tsuji | B65H 31/34 |
| 10,167,163 | B2 * | 1/2019 | Chanclon Fernandez | B65H 31/02 |
| 2008/0136090 | A1 * | 6/2008 | Bober | B65H 31/36 271/221 |
| 2016/0318316 | A1 | 11/2016 | Eoka et al. | |

FOREIGN PATENT DOCUMENTS

| | | | |
|---|---|---|---|
| CN | 105460672 | A | 4/2016 |
| CN | 105522828 | A | 4/2016 |
| JP | H04327459 | A | 11/1992 |
| JP | 2008162761 | A | 7/2008 |

* cited by examiner

PRINT OUTPUT AUXILIARY DEVICE AND PRINTING APPARATUS

CROSS-REFERENCES TO RELATED APPLICATIONS

This application claims the priority of Chinese patent application No. 201710525768.4, filed on Jun. 30, 2017, the entirety of which is incorporated herein by reference.

FIELD OF THE DISCLOSURE

The present disclosure generally relates to the field of printing apparatus technology and, more particularly, relates to an auxiliary device and a printing apparatus containing the auxiliary device.

BACKGROUND

After a printing of paper sheet by a printer is complete, the printed paper sheet is outputted into a paper output tray through an eject roller. Because a rotational speed of the eject roller is low, a speed of the paper sheet outputted from the eject roller is low and the paper sheet outputted from the eject roller stays at a position close to the eject roller. Because the stay position of the outputted paper sheet from the eject roller is close to the eject roller, the outputted paper sheet from the eject roller will be in contact with subsequent paper sheet that is being outputted, and exert a resistance force to the paper sheet that is being outputted. Accordingly, the paper sheet that is being outputted stays at a position closer to the eject roller and continues to affect the paper sheet to be subsequently outputted.

As the number of the paper sheets outputted from the eject roller increases, the outputted paper sheet gets closer and closer to the subsequent paper sheet that is being outputted, the contact area between sheets of the paper becomes larger and larger, and the resistance to the subsequent paper sheet that is being outputted becomes larger and larger. Accordingly, a paper jam will occur.

In addition to printers, other printing apparatus such as copiers also have same paper jam issues. The disclosed print output auxiliary device and printing apparatus are directed to solve one or more problems set forth above and other problems in the art.

BRIEF SUMMARY OF THE DISCLOSURE

One aspect of the present disclosure includes a printing apparatus. The printing apparatus includes a print output device, including a print exit. The printing apparatus also includes an auxiliary device disposed at the print exit of the print output device and having a first position state and a second position state. During a transition of the auxiliary device between the first position state and the second position state, the auxiliary device pushes print outputted from the print exit to move in a direction away from the print exit.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION

Reference will now be made in detail to various embodiments of the disclosure, which are illustrated in the accompanying drawings. Wherever possible, the same reference numbers will be used throughout the drawings to refer to the same or the alike parts. The described embodiments are some embodiments but not all of the embodiments of the present disclosure are described herein. Based on the disclosed embodiments, persons of ordinary skill in the art may derive other embodiments consistent with the present disclosure, all of which are encompassed within the scope of the present disclosure.

The disclosed embodiments in the present disclosure are merely examples for illustrating the general principles of the invention. Any equivalents or modifications thereof, without departing from the spirit and principle of the present disclosure, fall within the true scope of the present disclosure.

Moreover, in the present disclosure, the terms "include" and "contain" and their derivatives mean inclusion but not limitation. The term "or" is inclusive and means "and/or". The term "and/or" may be used to indicate that two associated objects may have three types of relations. For example, "A and/or B" may represent three situations: A exists, A and B coexist, and B exists.

The present disclosure provides an auxiliary device and a printing apparatus. For example, an auxiliary device may be a print output auxiliary device and may be configured at a print exit of a print output device of a printing apparatus. As used herein, the term "prints" or "print" may refer to a printed matter processed by and exited from the printing apparatus through the print output device via the print exit. In some embodiments, the prints/print may include a printed paper sheet, a printed plastic film, a printed glass plate, etc., printed by the printing apparatus.

Figure 1:
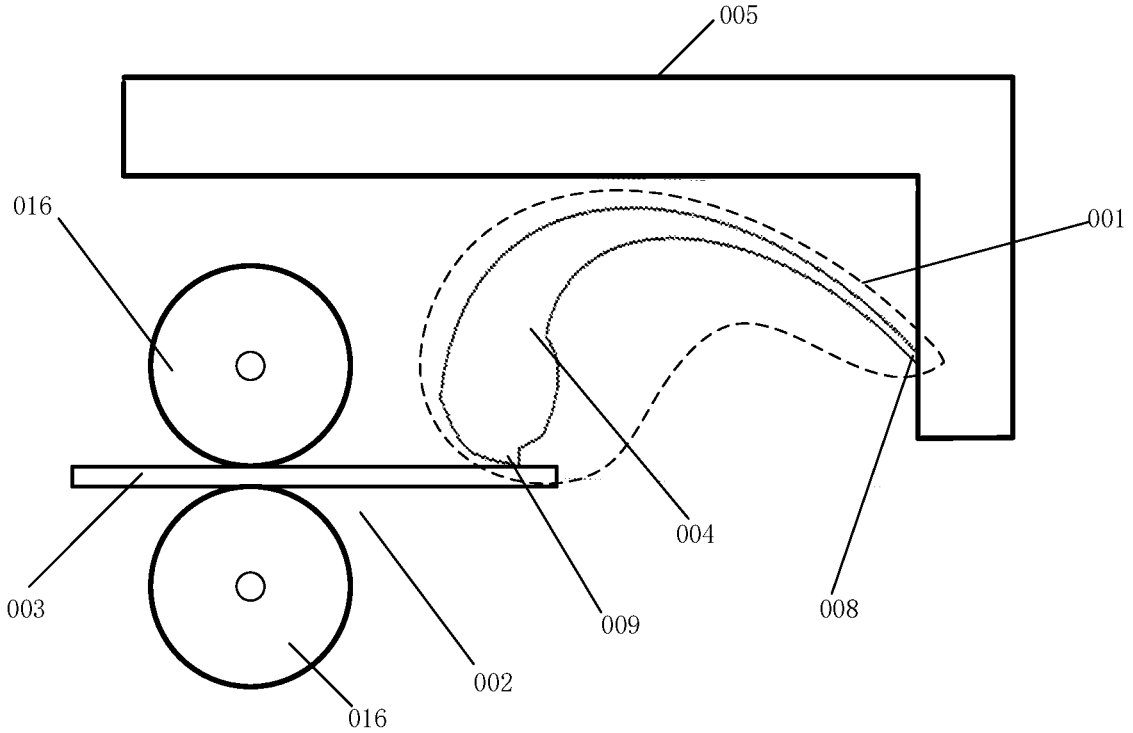
FIG. 1 illustrates a schematic diagram of an example of an auxiliary device at a first position state consistent with various disclosed embodiments of the present disclosure.
Figure 2:
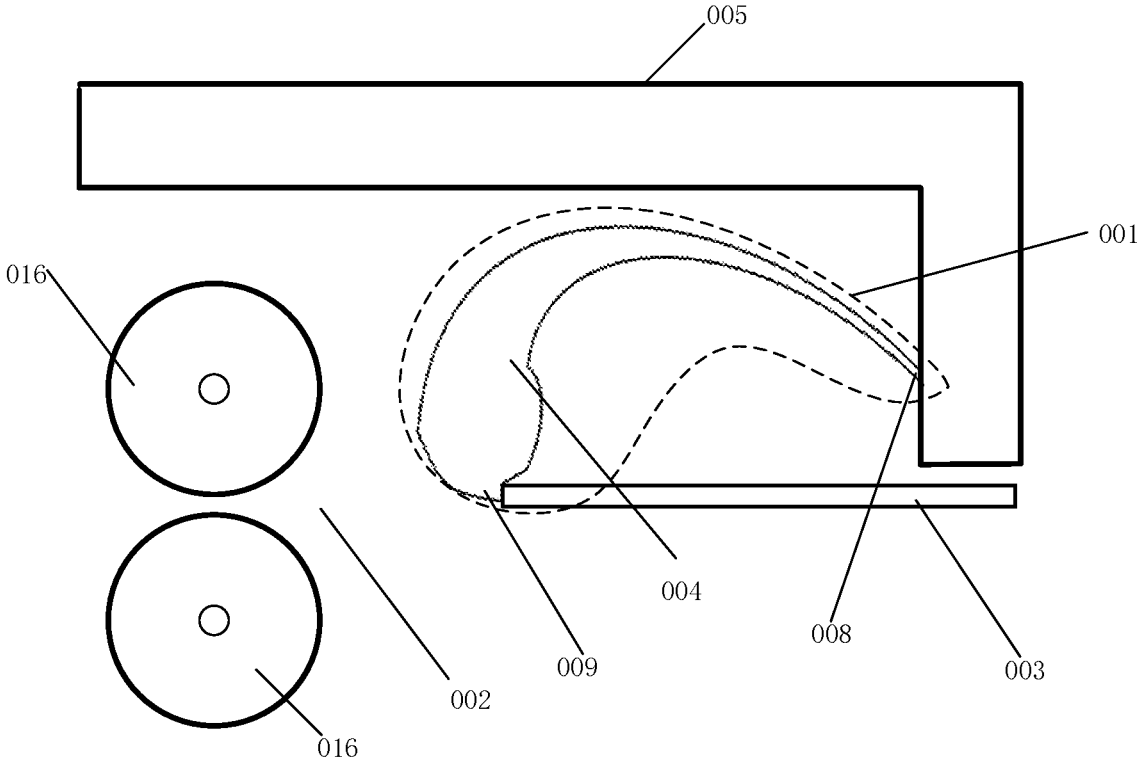
FIG. 2 illustrates a schematic diagram of an example of an auxiliary device at a second position state consistent with various disclosed embodiments of the present disclosure.

In some embodiments, the auxiliary device may have a first position state and a second position state as illustrated in FIGS. 1-2.

Referring to FIG. 1 and FIG. 2, a disclosed auxiliary device 001 may be disposed at a print exit 002 of a printing apparatus. The auxiliary device 001 may have a first position state (illustrated in FIG. 1) and a second position state (illustrated in FIG. 2). As shown in FIG. 1, in the first position state, the auxiliary device 001 may have a first relative-position relationship with prints (or print) 003 outputted from the print exit 002. As shown in FIG. 2, in the second position state, the auxiliary device 001 may have a second relative-position relationship with the prints 003 outputted from the print exit 002. Referring to FIG. 1 and FIG. 2, during the transition of the auxiliary device 001 from the first position state to the second position state, the auxiliary device 001 may push the prints 003 outputted from the print exit 002 to move in a direction away from the print exit 002.

As shown in FIG. 1 and FIG. 2, the print exit 002 may be a slot between two upper and lower eject rollers 016. The two upper and lower eject rollers 016 may output the prints, such as a printed paper sheet, to a specific position (e.g., a paper tray) through the slot. In some embodiments, there are many types of the prints, such as a printed paper sheet, a printed plastic film, a printed textile film, and a printed metal sheet, etc. The disclosed print output device in the printing apparatus may include a printer, a copier, a fax, and a photo printing apparatus, etc. The disclosed auxiliary device may not be the main drive component for outputting the prints, and may assist the above main drive component (e.g., the eject roller 016) to output the prints.

As shown in FIG. 1 and FIG. 2, the auxiliary device 001 may include an output auxiliary member 004. A first terminal 008 of the output auxiliary member 004 may be disposed on the printing apparatus (e.g., on a housing 005 of the printing apparatus illustrated in FIG. 1 and FIG. 2), and a second terminal 009 of the output auxiliary member 004 may be suspended at the print exit 002. During the transition of the output auxiliary member 004 from the first auxiliary position state to the second auxiliary position state, the second terminal 009 of the output auxiliary member 004 may push the prints 003 outputted from the print exit 002 to move in the direction away from the print exit 002.

In response to the auxiliary device 001, in some case, only including the output auxiliary member 004, the output auxiliary member 004 is used as the auxiliary device 001.

Figure 3:
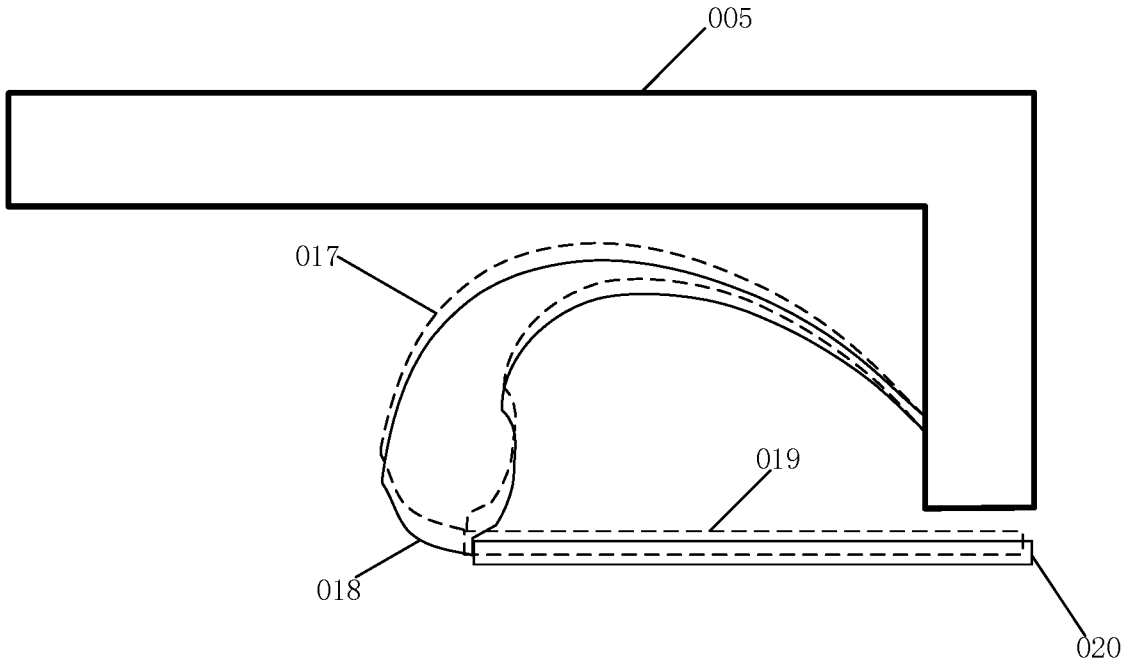
FIG. 3 illustrates a schematic diagram of an example of a position state change of an output auxiliary member consistent with various disclosed embodiments of the present disclosure.

As shown in FIG. 1, in the first auxiliary position state, the second terminal 009 of the output auxiliary member 004 may be above the prints 003. A distance between the second terminal 009 of the output auxiliary member 004 and the first terminal 008 of the output auxiliary member 004 may be a first distance. As shown in FIG. 2, a height of the second terminal 009 of the output auxiliary member 004 in the second auxiliary position state may be lower than that in the first auxiliary position state. At the same time, the distance between the second terminal 009 and the first terminal 008 of the output auxiliary member 004 in the second auxiliary position state may become smaller with respect to the first distance in the first auxiliary position state. FIG. 3 illustrates the two position states of the disclosed output auxiliary member 004, to show the difference between the first auxiliary position state and the second auxiliary position state. As shown in FIG. 3, a shape labeled 017 may denote the output auxiliary member in the first auxiliary position state, and a shape labeled 018 may denote the output auxiliary member in the second auxiliary position state. Variations in the two position states may enable the second terminal 009 of the output auxiliary member 004 to push the prints to move in the direction away from the print exit 002 (e.g., right of the viewing angle illustrated in FIG. 3). For example, as shown in FIG. 3, the second terminal 009 of the output auxiliary member 004 may push the prints to move from a position labeled 019 to a position labeled 020. Because a pushing force is given to the prints, in some embodiments, an output speed of the prints may be improved, such that the prints may stay at a position substantially far away from the print exit, thereby avoiding the occurrence of a paper jam.

The output auxiliary member 004 may be at least partially made of an elastic material. The elastic material may provide elastic deformation to switch the output auxiliary member between the first auxiliary position state and the second auxiliary position state. In some embodiments, there are many types of the elastic material, e.g., metal, plastic, and wood, etc.

In some embodiments, a distance from the first terminal 008 of the output auxiliary member 004 to the print exit 002 may be greater than a distance from the second terminal 009 of the output auxiliary member 004 to the print exit 002.

In some embodiments, the distance from the second terminal 009 of the output auxiliary member 004 in the first auxiliary position state to the print exit 002 may be smaller than the distance from the second terminal 009 of the output auxiliary member 004 in the second auxiliary position state to the print exit 002. Accordingly, during the transition of the output auxiliary member 004 from the first auxiliary position state to the second auxiliary position state, the second terminal 009 of the output auxiliary member 004 may move in the direction away from the print exit 002, to push the prints 003 to move in the direction away from the print exit 002.

Figure 4:
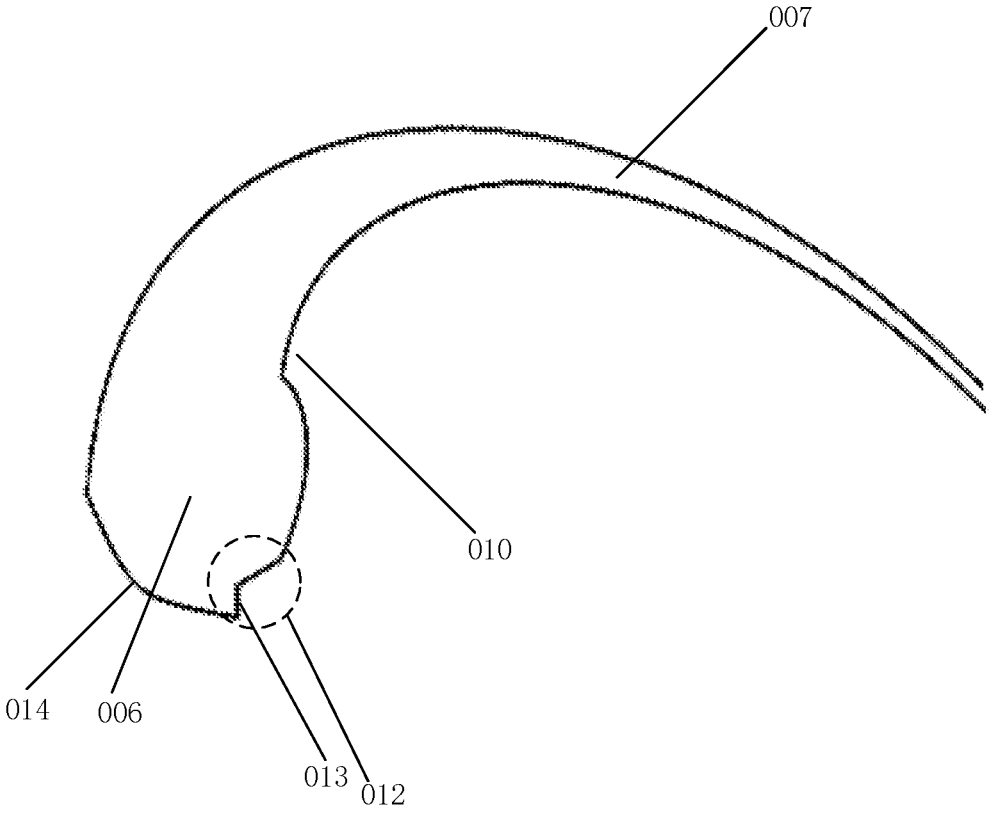
FIG. 4 illustrates a structural diagram of an example of an output auxiliary member consistent with various disclosed embodiments of the present disclosure.

FIG. 4 illustrates a structural diagram of the disclosed output auxiliary member 004. In some embodiments, referring to FIG. 4, the output auxiliary member 004 may include a weight body 006, and an elastic part 007 made of the elastic material. A first terminal 010 of the elastic part 007 may be fixedly connected to a first terminal (not illustrated in FIG. 4) of the weight body 006, and a second terminal (not illustrated in FIG. 4) of the elastic part 007 may be the first terminal 008 of the output auxiliary member 004. A second terminal (not illustrated in FIG. 4) of the weight body 006 may be the second terminal 009 of the output auxiliary member 004. The weight body 006 may allow the output auxiliary member 004 to switch from the first auxiliary position state to the second auxiliary position state in response to a gravity alone.

The elastic part 007 may have a certain amount of deformation. In response to the elastic part 007 being deformed, the weight body 006 may be driven to move. A weight of the weight body 006 may be a first weight, and the first weight may be in a range of approximately 10 grams-100 grams. Because the weight body 006 has a certain weight, the weight body 006 may have a high momentum in response to being driven by the elastic part 007. Further, in response to the weight body 006 being in contact with the prints 003, a large pushing force may be exerted on the prints 003 to push the prints 003 to move in the direction away from the print exit 002.

Further, the elastic part 007 may be an arc-shaped elastic piece. Referring to FIG. 1 and FIG. 4, the arc-shaped elastic piece may be arched in a direction away from a storage element of the outputted prints 003. During the transition from the first auxiliary position state to the second auxiliary position state, the output auxiliary member 004 may exert a force on the weight body 006 through a pre-stress in the direction away from the print exit 002. Due to the pre-stress force, the arc-shaped elastic piece may exert a greater pushing force on the prints 003 with respect to a planar elastic piece. At the same time, because the arc-shaped elastic piece is arched in the direction away from the storage element of the outputted prints 003, the elastic part 007 may not be in contact with the prints 003 and, thus, may not disturb the process in which the weight body 006 pushes the prints 003.

To enable the output auxiliary member 004 to better push the prints 003, as shown in FIG. 4, in some embodiments, the second terminal of the output auxiliary member 004 may have a first notch 012, and the first notch 012 may have a first acting surface 013. During the transition of the output auxiliary member 004 from the first auxiliary position state to the second auxiliary position state, the first acting surface 013 may push the prints 003 outputted from the print exit 002 to move in the direction away from print exit 002.

The first notch 012 of the output auxiliary member 004 may "jam" the prints 003 to a certain extent, to prolong a contact time between the output auxiliary member 004 and the prints 003. Therefore, the output auxiliary member 004 may push the prints 003 for a longer period of time, such that the prints 003 may be fallen in a position farther away from the print exit 002 to ensure smooth output of the prints. The first acting surface 013 is not limited to a vertical surface illustrated in FIG. 4, and may be a curved surface, or a bevel, etc.

In some embodiments, the transition of the output auxiliary member 004 from the first auxiliary position state to the second auxiliary position state may be driven by an elastic force of the output auxiliary member 004. For example, the output auxiliary member 004 may be in a bending energy storage state in the first auxiliary position state. As the bending amount of the output auxiliary member 004 decreases, the output auxiliary member 004 may release energy and change to the second auxiliary position state (e.g., a natural state) after pushing the prints 003.

In other embodiments, the transition of the output auxiliary member 004 from the first auxiliary position state to the second auxiliary position state may be driven by the gravity of the output auxiliary member 004, and the first terminal 008 of the output auxiliary member 004 may be hinged to the printing apparatus. In response to the gravity, the output auxiliary member 004 may rotate around the first terminal 008 of the output auxiliary member 004 along with the falling of the output auxiliary member 004. The rotation process of the output auxiliary member 004 may be the transition of the output auxiliary member 004 from the first auxiliary position state to the second auxiliary position state, and the output auxiliary member 004 may push the prints 003 during the rotation process.

In other embodiments, the transition of the output auxiliary member 004 from the first auxiliary position state to the second auxiliary position state may be driven by a magnetic force. For example, the output auxiliary member 004 may contain a ferromagnetic substance, and an electromagnet may be provided under the output auxiliary member 004. At power on, the electromagnet may attract the output auxiliary member 004 to move downward by the magnetic force. Because the first terminal 008 of the output auxiliary member 004 is disposed on the printing apparatus and cannot move downward, the second terminal 009 of the output auxiliary member 004 may rotate around the first terminal 008 of the output auxiliary member 004, and push the prints 003 during the rotation process.

Because the printing apparatus can continuously output a plurality of prints, in some embodiments, every outputted prints may be pushed once. Because the output auxiliary member 004 may be in the second position state after pushing the print every time, the output auxiliary member 004 may desire to be in the first auxiliary position state again to push prints to be subsequently outputted. A manner of the transition of the output auxiliary member 004 from the second auxiliary position state to the first auxiliary position state may include the following.

In response to the printing apparatus outputting first prints, the first print outputted from the print exit 002 may be in contact with the second terminal 009 of the output auxiliary member 004 to enable the output auxiliary member 004 to be in the first auxiliary position state. After outputting of the first prints is complete, the output auxiliary member 004 may be switched from the first auxiliary position state to the second auxiliary position state.

Figure 5:
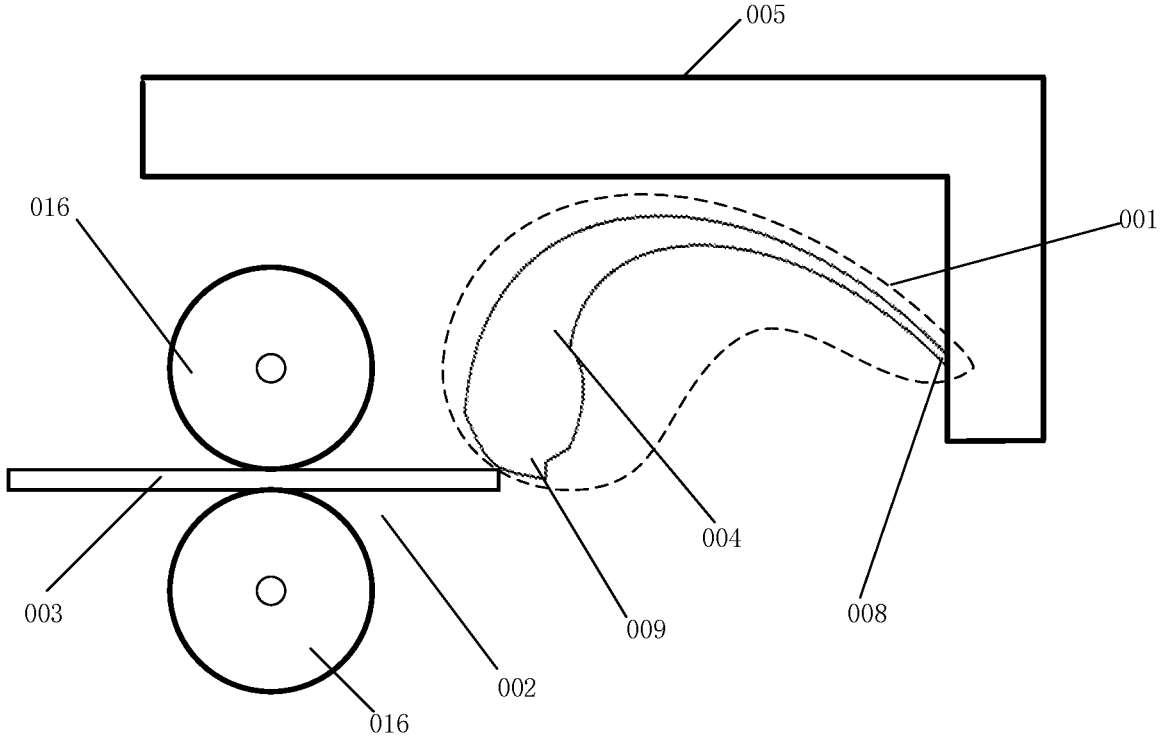
FIG. 5 illustrates a schematic diagram of an example of print pushing an output auxiliary member consistent with various disclosed embodiments of the present disclosure.

FIG. 5 illustrates a schematic diagram of the prints pushing the output auxiliary member consistent with various disclosed embodiments of the present disclosure. As shown in FIG. 5, in response to the printing apparatus outputting the prints 003, the prints 003 may be in contact with the second terminal 009 of the output auxiliary member 004. Because the printing apparatus is still exerting a pushing force on the prints 003, the prints 003 may force the second terminal 009 of the output auxiliary member 004 to be raised, such that the output auxiliary member 004 may be in an energy storage state (e.g., gravity, or elastic force). The energy storage state may be the first auxiliary position state. Accordingly, additional power may not desire to be provided, and the structure may be simple.

To avoid the occurrence of a "paper jam" phenomenon during the process in which the prints 003 forces the second terminal 009 of the output auxiliary member 004 to be raised, as shown in FIG. 4, one side of the second terminal 009 of the output auxiliary member 004 facing the print exit 002 may include an arc surface 014. Accordingly, after the prints 003 outputted from the print exit is in contact with the arc surface 014, the output auxiliary member 004 may be switched from the second auxiliary position state to the first auxiliary position state, and, at the same time, the output auxiliary member 004 may not easily block the movement of the prints 003.

In the disclosed auxiliary device, the auxiliary device may be disposed at the print exit of the printing apparatus. The auxiliary device may have the first position state and the second position state. In the first position state, the auxiliary device may have the first relative-position relationship with the print outputted from the print exit. In the second position state, the auxiliary device may have the second relative-position relationship with the print outputted from the print exit. During the transition of the auxiliary device from the first position state to the second position state, the auxiliary device may push the print outputted from the print exit to move in the direction away from the print exit. In some embodiments, the auxiliary device may be disposed at the print exit to assist outputting of the prints. By controlling the position state of the auxiliary device, the auxiliary device may push the prints to move during the transition of the position states, such that the output speed of the prints may be improved, and the print jam may be avoided.

Figure 6:
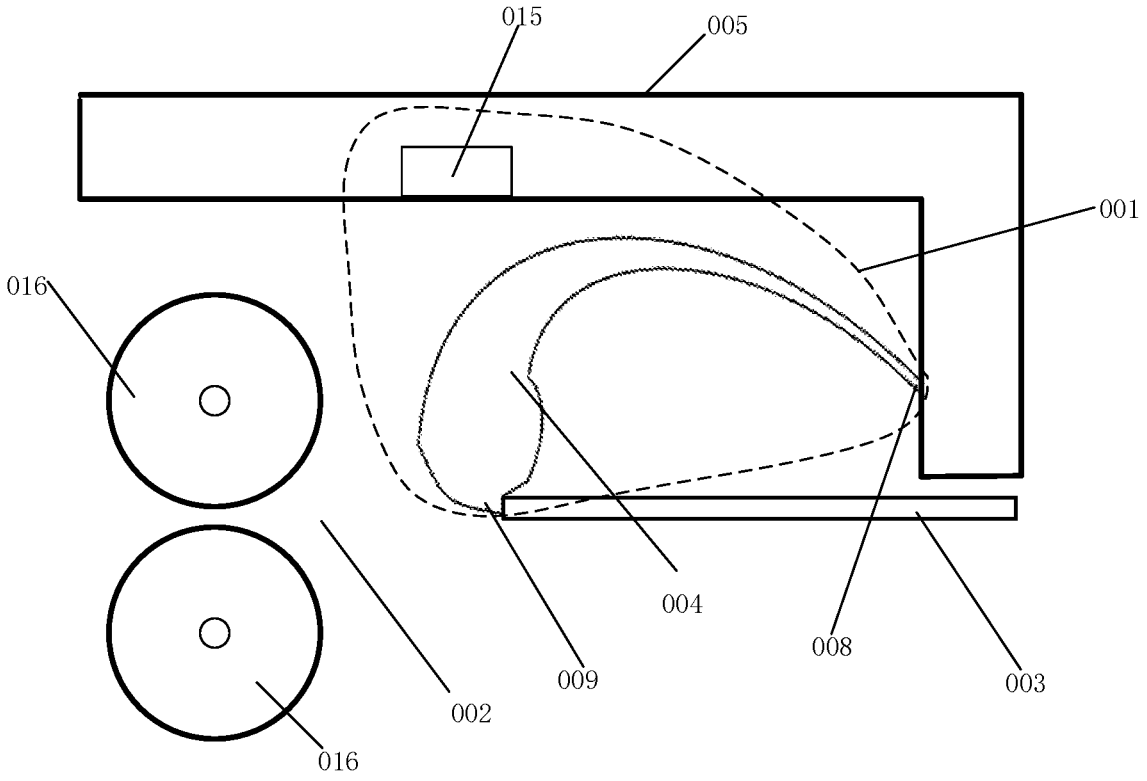
FIG. 6 illustrates a structural diagram of an example of an auxiliary device consistent with various disclosed embodiments of the present disclosure.

Another manner of the transition of the output auxiliary member 004 from the second auxiliary position state to the first auxiliary position state may include the following. As shown in FIG. 6, the auxiliary device 001 may also include an electromagnet 015 disposed on the printing apparatus. In some embodiments, the ferromagnetic substance may be provided on the output auxiliary member 004. In other embodiments, the output auxiliary member 004 may be made of a material containing the ferromagnetic substance.

At power on, the electromagnet 015 may attract the output auxiliary member 004 and enable the output auxiliary member 004 to be in the first auxiliary position state. At power off, the electromagnet 015 may stop attracting the output auxiliary member 004 and enable the output auxiliary member 004 to be in the second auxiliary position state.

In other embodiments, the disclosed electromagnet 015 may attract the output auxiliary member 004 and enable the output auxiliary member 004 to be in the second auxiliary position state by the magnetic force. In other words, at power on, the electromagnet 015 may attract the output auxiliary member 004 and enable the output auxiliary member 004 to be in the second auxiliary position state. At power off, the electromagnet 015 may stop attracting the output auxiliary member 004 and enable the output auxiliary member 004 to be in the first auxiliary position state.

In response to the electromagnet 015 attracting the output auxiliary member 004 by the magnetic force and changing the auxiliary position state of the output auxiliary member 004, the output auxiliary member 004 may store energy (e.g., elastic potential energy, or gravitational potential energy). Accordingly, in response to the electromagnet 015 being powered off, the energy stored in the output auxiliary member 004 may restore the auxiliary position state of the output auxiliary member 004. That is, in response to the electromagnet 015 being powered off, the output auxiliary member 004 may restore to the auxiliary position state before being attracted by the electromagnet 015.

In other embodiments, a plurality of electromagnets may be simultaneously disposed on the upper and lower sides of the output auxiliary member 004. To place the output auxiliary member 004 in the first auxiliary position state, the plurality of electromagnets on one side (e.g., the upper side) of the output auxiliary member 004 may be energized to attract the output auxiliary member 004 and enable the output auxiliary member 004 to be in the first auxiliary position state. To place the output auxiliary member 004 in the second auxiliary position state, the plurality of electromagnets on the other side (e.g., the lower side) of the output auxiliary member 004 may be energized to attract the output auxiliary member 004 and enable the output auxiliary member 004 to be in the second auxiliary position state. Accordingly, the energy storage process described above may be eliminated.

Figure 7:
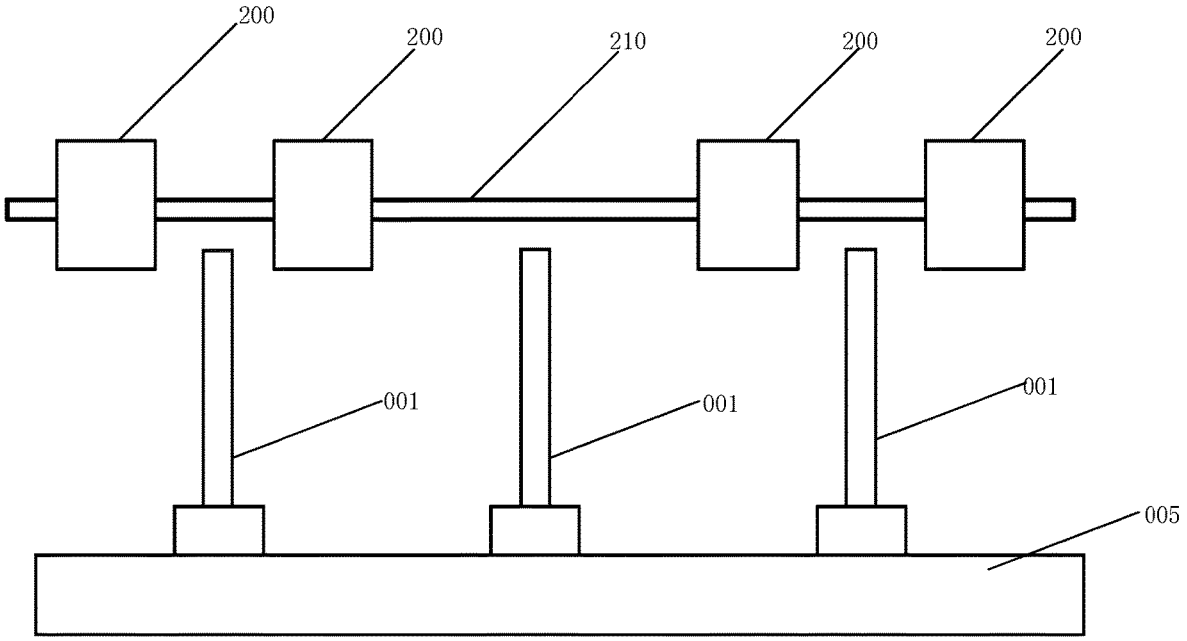
FIG. 7 illustrates a structural diagram of an example of a printing apparatus consistent with various disclosed embodiments of the present disclosure.

The present disclosure also provides a printing apparatus. FIG. 7 illustrates a structural diagram of a printing apparatus consistent with various disclosed embodiments of the present disclosure. As shown in FIG. 7, the printing apparatus may include a housing 005, a print output device 200, and the disclosed auxiliary device 001. The print output device 200 may include a print exit, and the auxiliary device 001 may be disposed at the print exit.

In some embodiments, the print output device 200 may be an eject roller driven by a power shaft 210. The auxiliary device 001 may be disposed on the housing 005. The disclosed printing apparatus may include at least one auxiliary device 001. In some embodiments, as shown in FIG. 7, the disclosed printing apparatus may include a plurality of auxiliary devices 001, and positions where the plurality of auxiliary devices 001 are disposed on the housing 005 may be in a straight line, which is parallel to an axis of the power shaft. Accordingly, the plurality of auxiliary devices 001 may jointly push the prints with a same or similar force. Therefore, not only the output speed of the prints may be increased, but also an offset of the print output direction caused by an uneven force exerted by the plurality of auxiliary devices 001 may be avoided.

In the disclosed printing apparatus, the auxiliary device may be provided at the print exit. The auxiliary device may have the first position state and the second position state. In the first position state, the auxiliary device may have the first relative-position relationship with the print outputted from the print exit. In the second position state, the auxiliary device may have the second relative-position relationship with the print outputted from the print exit. During the transition of the print output auxiliary device from the first position state to the second position state, the auxiliary device may push the print outputted from the print exit to move in the direction away from the print exit. In some embodiments, the auxiliary device may be disposed at the print exit to assist outputting of the prints. By controlling the position state of the auxiliary device, the auxiliary device may push the prints to move during the transition of the position states, such that the output speed of the prints may be improved, and the print jam may be avoided.

The various embodiments in the present specification are described in a progressive manner. Each embodiment mainly describes in terms of differences from other embodiments, and the same or similar parts between the various embodiments may be referred to each other.

The device and method described in the above embodiments may be realized through other approaches. That is, the description on the methods and devices in the above embodiments may only be schematic examples.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A printing apparatus, comprising:

a print output device, including a print exit; and an auxiliary device, disposed at the print exit of the print output device and having a first position state and a second position state, the auxiliary device including an output auxiliary member having a first terminal disposed on a housing of the printing apparatus, and a second terminal suspended at the print exit, the output auxiliary member including a weight body and an elastic part made of an elastic material;

wherein, during a transition of the auxiliary device between the first position state and the second position state, the auxiliary device pushes print outputted from the print exit to move in a direction away from the print exit;

the weight body allows the output auxiliary member to switch from a first auxiliary position state to a second auxiliary position state in response to gravity; and during a transition between the first auxiliary position state and the second auxiliary position state, the output auxiliary member pushes the print outputted from the print exit to move away from the print exit.

2. The apparatus according to claim 1, wherein:

the output auxiliary member is at least partially made of the elastic material, and the elastic material provides elastic deformation to switch the output auxiliary member between the first auxiliary position state and the second auxiliary position state.

3. The apparatus according to claim 2, wherein a first terminal of the elastic part is fixedly connected to a first terminal of the weight body, a second terminal of the elastic part is the first terminal of the output auxiliary member, and a second terminal of the weight body is the second terminal of the output auxiliary member.

4. The apparatus according to claim 3, wherein:

the elastic part is an arc-shaped elastic piece, the arc-shaped elastic piece is arched in a direction away from a storage element of the outputted print, and during the transition of the output auxiliary member from the first auxiliary position state to the second auxiliary position state, the output auxiliary member exerts a force on the weight body through a pre-stress in the direction away from the print exit.

5. The apparatus according to claim 3, wherein:

a weight of the weight body is in a range of approximately 10 grams-100 grams.

6. The apparatus according to claim 1, wherein:

a distance from the second terminal of the output auxiliary member in the first auxiliary position state to the print exit is smaller than a distance from the second terminal of the output auxiliary member in the second auxiliary position state to the print exit.

7. The apparatus according to claim 1, wherein:

the second terminal of the output auxiliary member has a first notch, and the first notch has a first acting surface, and during the transition of the output auxiliary member from the first auxiliary position state to the second auxiliary position state, the first acting surface pushes the print outputted from the print exit to move in the direction away from print exit.

8. The apparatus according to claim 1, wherein:

in response to the print output device outputting a first print, the first print outputted from the print exit is in contact with the second terminal of the output auxiliary member to enable the output auxiliary member to be in the first auxiliary position state; and after outputting of the first print is complete, the output auxiliary member is switched from the first auxiliary position state to the second auxiliary position state.

9. The apparatus according to claim 8, wherein:

one side of the second terminal of the output auxiliary member facing the print exit includes an arc surface, wherein after the print outputted from the print exit is in contact with the arc surface, the output auxiliary member is switched from the second auxiliary position state to the first auxiliary position state.

10. The apparatus according to claim 1, wherein the auxiliary device further includes:

an electromagnet, disposed on the printing apparatus.

11. The apparatus according to claim 10, wherein:

a ferromagnetic substance is provided on the output auxiliary member, or the output auxiliary member is made of a material including the ferromagnetic sub stance.

12. The apparatus according to claim 11, wherein:

at power on, the electromagnet attracts the output auxiliary member and enables the output auxiliary member to be in one of the first auxiliary position state and the second auxiliary position state, and at power off, the electromagnet stops attracting the output auxiliary member and enables the output auxiliary member to be in the other of the first auxiliary position state and the auxiliary second position state.

13. The apparatus according to claim 10, further including:

a plurality of electromagnets disposed on upper and lower sides of the output auxiliary member, wherein:

to place the output auxiliary member in the first auxiliary position state, the plurality of electromagnets on the upper side of the output auxiliary member are energized to attract the output auxiliary member, and to place the output auxiliary member in the second auxiliary position state, the plurality of electromagnets on the lower side of the output auxiliary member are energized to attract the output auxiliary member.

14. The apparatus according to claim 1, wherein:

a height of the second terminal of the output auxiliary member in the second auxiliary position state is lower than a height of the second terminal of the output auxiliary member in the first auxiliary position state, and a distance between the second terminal and the first terminal of the output auxiliary member in the second auxiliary position state is smaller than a distance between the second terminal and the first terminal of the output auxiliary member in the first auxiliary position state.

15. The apparatus according to claim 1, wherein:

the auxiliary device in the first position state has a first relative-position relationship with the print outputted from the print exit, and the auxiliary device in the second position state has a second relative-position relationship with the print outputted from the print exit.

16. The apparatus according to claim 1, wherein:

the transition of the output auxiliary member between the first auxiliary position state and the second auxiliary position state is driven by one or more of an elastic force, a gravitational force, and a magnetic force.

17. The apparatus according to claim 1, wherein:

the print output device is an eject roller driven by a power shaft.

18. The apparatus according to claim 17, further including:

a plurality of auxiliary devices, disposed on the housing in a straight line parallel to an axis of the power shaft.

19. The apparatus according to claim 1, wherein:

the print output device includes a printer, a copier, a fax machine, and a photo printing apparatus.

* * * * *